United States Patent [19]

Radovich

[11] Patent Number: 4,515,493

[45] Date of Patent: May 7, 1985

[54] PORTABLE DESK AND BRIEFCASE

[76] Inventor: Albert F. Radovich, 54 Southlite Cir., Sacramento, Calif. 95831

[21] Appl. No.: 555,900

[22] Filed: Nov. 28, 1983

Related U.S. Application Data

[63] Continuation-in-part of Ser. No. 282,392, Jul. 13, 1981, abandoned.

[51] Int. Cl.[3] ..... B42F 13/12; D45F 3/00; D47B 3/10

[52] U.S. Cl. ..... 402/4; 402/70; 402/72; 150/110; 190/11; 190/900; 190/901; 190/902; 383/4

[58] Field of Search ..... 402/4, 70, 71, 72; 190/11, 900, 901, 902; 383/4; 150/34

[56] References Cited

U.S. PATENT DOCUMENTS

| | | | |
|---|---|---|---|
| 1,121,422 | 12/1914 | Tydings | 190/11 X |
| 1,329,429 | 2/1920 | Perry | 190/11 |
| 1,491,807 | 4/1924 | McLinn | 190/11 |
| 3,904,003 | 9/1975 | Margerum | 190/11 |
| 4,161,201 | 7/1979 | Carp | 150/34 X |

FOREIGN PATENT DOCUMENTS

| | | | |
|---|---|---|---|
| 0759902 | 8/1940 | Fed. Rep. of Germany | 402/4 |

*Primary Examiner*—Paul A. Bell
*Assistant Examiner*—Taylor J. Ross
*Attorney, Agent, or Firm*—Claude A. S. Hamrick

[57] ABSTRACT

A portable desk and briefcase includes a bottom member 20 foldably connected to a front member 16 and a back member 18. The opposite edge of member 18 foldably connects top member 38, which in turn is foldably connected to front flap member 42. Side members 26 and 28 are foldably connected to back member 18 along lines 30 and 32, respectively, which are spaced inwardly from the edges of member 18. Upon folding to form a briefcase, the folded side members, being inwardly spaced, support the other members in their folded positions. The side members are held in the folded position by securing means 78, 80. The top and bottom members each carry binders, and the front member carries, a plurality of pockets.

3 Claims, 5 Drawing Figures

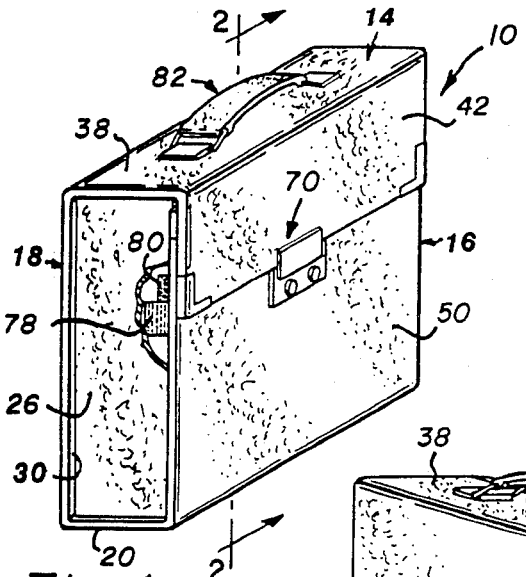
Fig_1
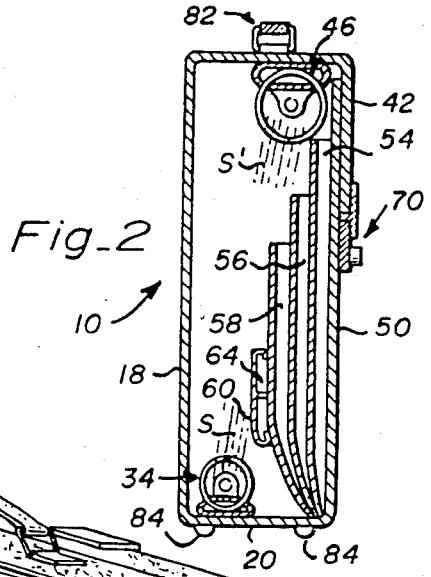
Fig_2
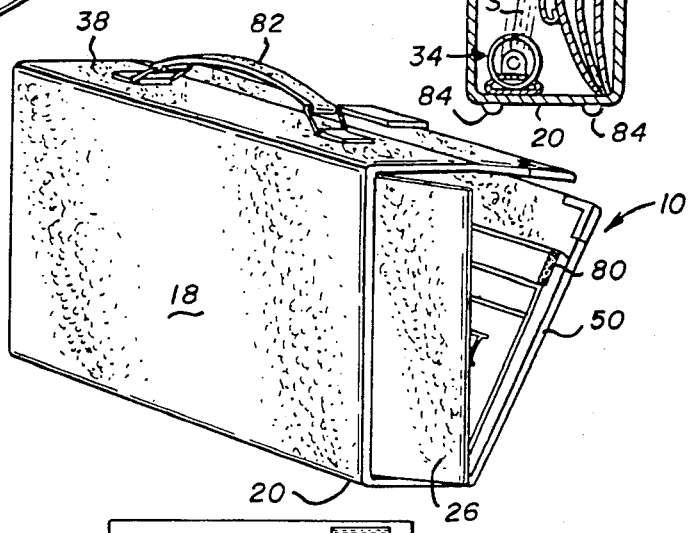
Fig_3
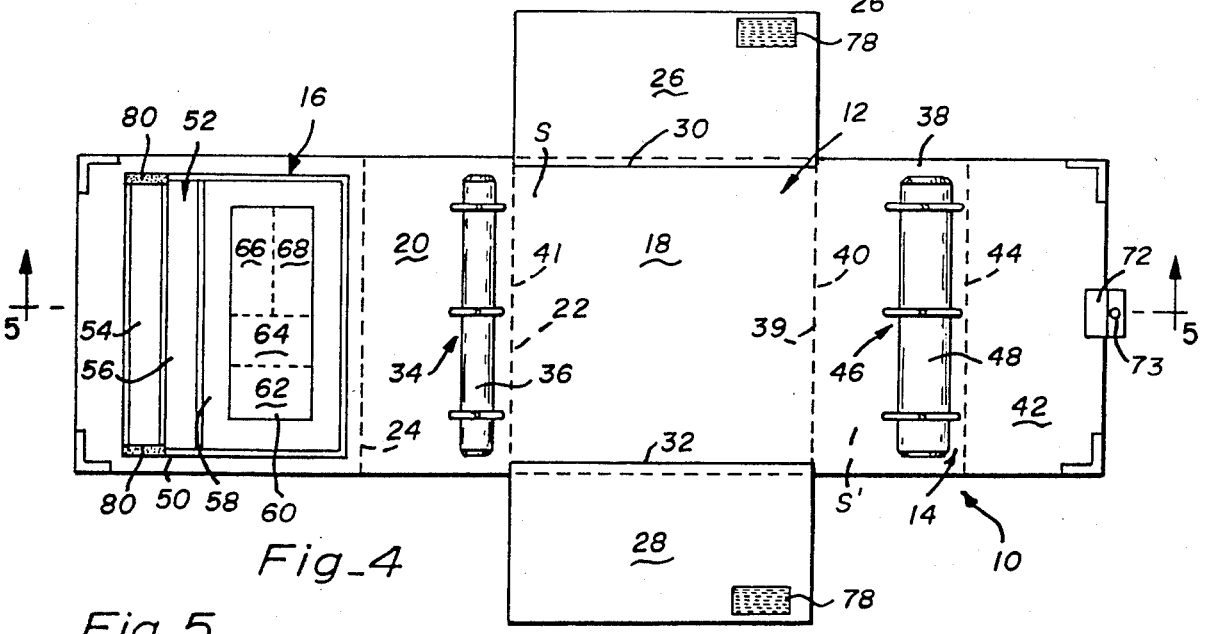
Fig_4
Fig_5
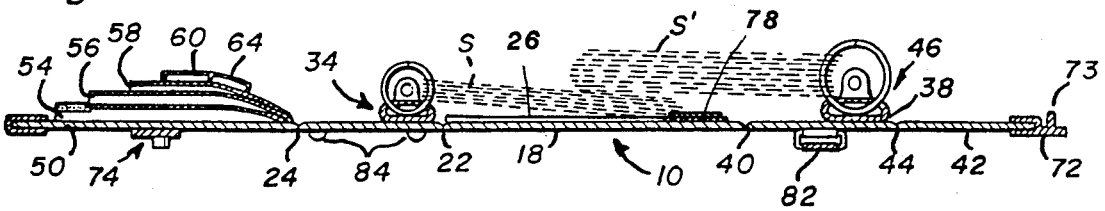

PORTABLE DESK AND BRIEFCASE

This application is a continuation in part of Applicant's prior application Ser. No. 282,392, filed July 13, 1981, now abandoned.

BACKGROUND OF THE INVENTION

1. Field of the Invention

This invention relates generally to cases for carrying various papers, and particularly to a case which can open into a substantially planar surface to form a desk.

2. Description of the Prior Art

The use of carrying cases of varying kinds is becoming more prevalent as more and more people find it convenient and even necessary to take work with them as they travel about or require large amounts of informative material at hand to perform their work. Accordingly, although the usual kinds of cases, such as attache cases, top-loading briefcases, portfolios, and the like, remain the most common cases used, there has developed an increasing need for specialized cases for facilitating the carrying out of various tasks.

Several specialized carrying cases have been proposed, an example of which can be found in U.S. Pat. No. 4,161,201, issued July 17, 1979 to B. Carp, wherein an organizer constructed for receiving a large number of specialized personal articles is arrangeable in the chamber of a rectangular carrying case of generally conventional construction. The organizer can be removed from the carrying case and laid flat for convenient access to the articles disposed in it.

There is a need, however, for a case having a configuration convenient for being carried about, but which will function as a desk and secretary when a user of the case has need to refer to the materials disposed within the case. This is particularly true when the materials within the case are sheets of informative material, forms to be completed, and the like.

SUMMARY OF THE PRESENT INVENTION

It is an object of the present invention to provide a case which converts into a desk.

It is another object of the present invention to provide a carrying case for programmed material related to a specific task or series of tasks to be performed by the user of the case, which case retains the material in an order keyed to the manner in which the material is to be used.

Yet another object of the present invention is to provide apparatus which normally is in the form of an attractive carrying case, but which can be conveniently unfolded so as to lie in a substantially singular plane for use as a "table-top" desk.

Briefly, these and other objects of the present invention are achieved by apparatus including first and second wall-forming parts hinged to one another and to a third wall-forming part preferably provided with a plurality of pockets arranged for receiving sheets of paper, business cards, writing implements, and the like. Each of the first and second parts, which preferably include snap-ring holders and the like, is comprised of a pair of portions or sections, with the first part having a smaller portion hingedly attached to a wall forming the base for the third part, and a larger portion being of substantially the same planar size as the wall of the third part. The second part has a section of substantially the same size as the smaller portion of the first part and hingedly attached to the larger portion of the first part in spaced relation to the third part so that the smaller portion of the first part will form a bottom of the apparatus when folded into a carrying case and the section of the second part which is hingedly attached to the first part forms a top to the case. A second section to the second part forms a flap which can be folded in overlapping relation with an outer surface of the wall of the third part and releasably secured thereto by a suitble lock arrangement. A handle is advantageously disposed on the outer surface of the section of the second part forming the top wall of the case to facilitate carrying of the case. The first part can have additional portions extending perpendicularly to the second part and the third part from the larger portion of the first part and being of a comparable size to the smaller portion of the first part so as to be foldable into planes substantially perpendicular to the larger portion of the first part and to form side walls of the case. These side walls can be held in place by a suitable adhering arrangement, such as a suitable fabric hook fastener, and the like.

It is an advantage of the invention that all of the materials for a specific job task, such as a sales presentation, can be conveniently organized for use in the three parts when the various parts are layed out substantially in a single plane so as to function as a desk, and when not in use or when being transported can be folded into an attractive carrying case.

Another advantage of the present invention is that work to be done in conjunction with the invention can be organized and performed in a more efficient manner than possible with conventional carrying cases.

IN THE DRAWING

FIG. 1 is a schematic, perspective view, partly broken away and in section, showing a portable desk and briefcase apparatus according to a present invention;

FIG. 2 is a sectional view taken generally along the line 2—2 of FIG. 1, but drawn to a larger scale;

FIG. 3 is a schematic, perspective view showing the apparatus of FIGS. 1 and 2 as seen from the left in FIG. 1, but in partly opened mode;

FIG. 4 is a schematic, top plan view showing the apparatus of FIGS. 1–3 unfolded so as to lie substantially in a single plane; and FIG. 5 is a schematic, sectional view taken along the line 5—5 of FIG. 4.

DESCRIPTION OF THE PREFERRED EMBODIMENTS

Referring now more specifically to the figures of the drawing, a portable desk and briefcase apparatus 10 according to the present invention is provided with a first binder part 12 and a second binder part 14 foldably attached to binder part 12. A receptacle part 16 is attached to binder part 12 in spaced relation to part 14 and is arranged for being folded over a portion of binder part 12 so as to lie parallel and coextensive therewith.

Binder part 12 includes a substantially planar first portion 18 which forms a back wall of case apparatus 10, and a substantially planar second portion 20 smaller than the first portion 18 when viewed in plan. Portions 18 and 20 are pivotally connected to one another by an integral hinge 22, while a similar integral hinge joins portion 20 to receptacle part 16. Binder part 12 also includes third and fourth portions 26 and 28 pivotally joined to portion 18 by integral hinges 30 and 32 and disposed so as to extend, when apparatus 10 is arranged in a single plane as seen in FIGS. 4 and 5, in opposite directions from portion 18 and perpendicular to the extent of parts 14 and 16 from the associated part 12. These latter portions 26, 28 are foldable into a position so as to form the side walls of the case apparatus 10, as best seen in FIGS. 1 and 3 of the drawings. It should be noted, however, that the hinges 30 and 32 are disposed on the inside face of portion 18 so as to allow portions 26 and 28 to fold into position inside the outside edges of portions 16, 18, 20 and 38, as shown in FIG. 1. Accordingly, when portions 26 and 28 are rotated into the open position shown in FIG. 4, the outer faces of the side wall forming portions 26 and 28 lie in substantially the same plane as that of the inside faces of portions 16, 18, 20 and 38, as shown in FIG. 5.

A holder arrangement 34 is mounted on the surface of portion 20 which is directed upwardly in FIGS. 4 and 5 so as to be within apparatus 10 when same is folded into a carrying case as seen in FIGS. 1–3. The portion 18 will be seen to form the back wall of a case formed from apparatus 10. Although holder arrangement 34 is illustrated as being formed by a conventional snap-ring holder 36, it will be appreciated that any suitable sheet holder as conventionally employed with binders can be used for holder arrangement 34.

Binder part 14 includes a substantially planar first section 38 integrally hinged at an edge 39 by a hinge 40 to portion 18 of part 12 of apparatus 10. A planar second section 42 of about the same size as section 38 is pivotally joined to section 38 by an integral hinge 44 so as to form a flap. A retaining device 46 is mounted on section 38 of part 14 for selectively holding sheets of planar material, such as paper, and preferably is the illustrated conventional snap-ring holder. It will be appreciated that as in the case of holder arrangement 34, another conventional sheet holding device other than holder 48 may be employed for retaining device 46. Further, although holder 48 is illustrated as being substantially larger than holder 34, it will be appreciated that a relative size of these elements can be varied as desired within the limits of the overall construction of apparatus 10.

Receptacle part 16 includes a substantially planar wall 50 pivotally joined to portion 20 of binder part 12 by the aforementioned integral hinge 24 and provided with a pocket arrangement 52 disposed for selectively receiving various articles.

Pocket arrangement 52 includes an expanding envelope 54 of generally conventional construction wherein a cover flap extends between and is connected to a pair of flexible side walls. In the illustrated embodiment a pair of pockets 56 and 58 are secured to the cover flap of envelope 54 adjacent the side walls thereof. Further, a piece 60 is sewn onto the pocket 58 in such a manner as to form a pair of pockets 62 and 64 arranged side by side and opening in the same direction as the pockets 56 and 58, and a pair of pockets 66 and 68 also arranged side by side and opening perpendicularly to pockets 62 and 64. While envelope 54 and pockets 56 and 58 can be used for holding various sheets of paper, booklets and the like, pockets 62 and 64 may be dimensioned so as to receive business cards, for example, and pockets 66 and 68 can receive writing implements and similar articles.

As can be appreciated from the drawings, wall 50 of part 16 is about the same size in plan as the portion 18 of binder part 12, and the portion 20 of binder part 12 and the section 38 of binder part 14 are also of about the same size in plan so that these like sized areas form pairs of opposite walls when apparatus 10 is folded into the form of a case as seen in FIGS. 1 and 2 of the drawing. Specifically, portion 18 and wall 50 form the back and front surfaces, respectively, of the case, while portion 20 and section 38 form the bottom and top surfaces. That is, each of the pairs including portion 18 and wall 50, and portion 20 and section 38, will be substantially parallel and coextensive when apparatus 10 is in its carrying case mode. Section 42 functions as a flap which partially overlaps the outwardly directed surface of wall 50, and is retained in such overlapping position by a suitable, known fastener 70 including a stud part 72 provided on the terminal edge of section 42 and a latch part 74 preferably including a reciprocating spring latch and disposed on the outer surface of wall 50 for retainingly receiving a pin 73 provided on part 72. Fastener 70 can be of any suitable kind of commonly used luggage lock, clasp, and the like, and due to its conventional construction will not be described in detail herein.

An adhering arrangement 78 is associated with the portions 26 and 28 of binder part 12 and with wall 50 of receptacle part 16 for releasably securing portions 26 and 28 to wall 50 when apparatus 10 is in the carrying case mode. As illustrated, this adhereing arrangement 76 comprises pieces 78 affixed to portions 26 and 28 and pieces 80 affixed to peripheral portions of envelope 54 of pocket arrangement 52, and constructed from a fabric, and the like, provided with hooks and loops to form a hook fastener which will adhere when the pieces 78 and 80 are pressed together and released when same are pulled apart. An example of such a material is that commonly marketed under the trademark VELCRO. This arrangement permits the flap portions 26 and 28 to be retained in place as side walls when apparatus 10 is in its carrying case mode.

A handle 82 is advantageously provided on the outwardly directed surface of section 38 of binder part 14, while it is advantageous that conventional feet 84 be provided on the outwardly directed surface of portion 20 of binder part 12 so as to form a supporting surface for apparatus 10 when in the case mode, as is conventional with briefcases, luggage, and the like.

Apparatus 10 can be constructed in a conventional manner as by covering pieces of cardboard or other suitable stiffening material with vinyl, leather, and the like. The integral hinges can be formed at the boundaries of the pieces of stiffener material.

In use, apparatus 10 can be laid out in substantially a single plane as shown in FIGS. 4 and 5 to be used as a desk to perform whatever function appropriate. When it is desired to either store apparatus 10, or to carry same from one place to another, apparatus 10 can be folded into a case by first folding portion 20 perpendicular to portion 18 and then bringing wall 50 perpendicular to portion 20 so as to be substantially parallel to and overlying portion 18. Now section 42 can be brought substantially perpendicular to portion 18 so as to be substantially parallel to and overlying portion 20 while extending from portion 18 and slightly beyond wall 50. Section 42 can now be brought down into overlapping relation with the outer surface of wall 50 and secured in such position by use of fastener 70. Portions 26 and 28 now are folded perpendicular to portion 18 and retained in place by adhering arrangement 76. Apparatus 10 now is in its carrying case mode and can be conveniently transported from one place to another by use of handle 82, or can be conveniently stored, in the manner of a briefcase, attache case, or piece of luggage. In the folded position illustrated in Fig. of the drawing, portions 26 and 28 form rigid side walls which engage the inside surfaces of portions 16, 18, 20 and 38 and maintain the shape of the apparatus even when relatively heavy contents are carried therein.

As can be readily understood from the abovedescription and from the drawings, a portable desk and briefcase apparatus according to the present invention provides a convenient portfolio for organizing programmed sales materials and the like. While the use of apparatus according to the invention can vary, one possible use will be set forth below by way of example.

A plurality of sheets of paper, and the like, designated S in the drawings can be secured in holder arrangement 34, while a further plurality of sheets of paper, designated S', can be inserted into retaining device 46. Preferably, sheets S' will be arranged overlapping sheets S as seen in FIGS. 4 and 5, but this arrangement can be varied as desired. The specific example being set forth herein is directed to an automobile sales approach. Thus, papers S are made up of a "Ball Game Chart" guide to a sale; an alphabetical index section listing all sold customers with space for additional sales to same customer or other family members; a monthly index forming a master owner's file listing all important information about a customer, a continuous follow-up check list and a personal data about the sale and the customer; and a monthly tab index forming a birthdate section listing all customers and their spouse's birthdays by the month for use in mailing birthday cards during a particular month. The papers designated S' can be composed of a daily index appointment schedule comprising a four section daily planar form including an hourly appointment section and owner contact listings, a list of active prospects, a list of daily showroom contacts, and daily prospecting lists, together with an alphabetical index work sheet section usable for inserting copies of work sheets, credit applications, and the like.

EXAMPLE OF A STEP BY STEP METHOD FOR USING THE INVENTION

1. Sold Customers.
   - A. Send "thank you" note to customer.
   - B. Enter customer's name in the index section by last name in the largest portion of the sections, leaving the four smallest sections blank for future sales to the same customer or family members. List the phone number and under the "code" column enter the numerical month number and year, example 4-81 (April, 1981). This refers to the April section of the master owners file. In the "page" column, enter the page number of the master owners file along with the A to E alphabet letter of that customer's data.
   - C. Enter all data about sale in the master owners file section making sure to note the page number, and the month, at the top of the page. Enter all personal facts and begin check list follow-up procedure, such as "thank you note," first contact after sale, etc.
   - D. Enter birth data along with name of customer and spouse in appropriate month of the birthday section for mailing of birthday cards.
   - E. Use cross reference directory to obtain names, addresses and phone numbers of ten neighbors of sold customer. Each of these neighbors become potential customers and may be supplemented for the ten daily mailers to owners, etc. They should be treated in the same manner, see #2, section C.
   - F. All sold customers must be entered into the "plan your day" schedule under owner contacts, seven days after sale. Example: sold 4-1-81, enter 4-8-81. In addition, enter sold customer in the second page of daily schedules. Example: 4-1-81 becomes 5-1-81. When that call is made, enter into the third page down in the schedule and continue same process thereafter for each three month period.
2. Appointments and daily time schedule.
   - A. Salesperson enters all floor time schedules for the month ahead along with days off in the hourly section at the top of the page, making sure room is left for any possible appointments during floor schedule or time off. It also becomes a daily personal calendar for haricuts, doctor appointments, etc.
   - B. Each day the salesperson should review all active prospects listed in the second part of the first page and schedule phone contacts or appointments accordingly.
   - C. Each day the salesperson should send out ten mailers to prior owners or leasees. Upon sending mailers, the customers must be listed in the daily prospecting list section on the reverse side of the page, and a notation made four days in the future for phone contact. Example, ten mailers mailed on April 1st—notation (call mailers 4-1) put in hourly section at 3:00 p.m. based upon a floor schedule that day from 9:00–3:00. When positive reactions are obtained from these phone contacts, the prospect automatically becomes an active prospect and should be listed as such in the appropriate day of the month for future contact. If a negative response is obtained, draw a line through the name so that he can be deleted from your prospect lists at the end of the month.
   - D. All "ups" or showroom contacts, phone calls, outside solicitation are to be listed in the third part of the time schedule or "daily ups" section. These prospects are to be treated exactly the same as mailers with notations made for follow-up calls in the hourly section, with the date of the contact circled. All circled notations will be found either on the active prospect, up, or daily prospect list of the day noted. The active prospect section is for all prospects to be contacted at some future date. Owners contact section is for customers sold in the past. They are listed and coded by "page" and "code". The "code" column is for designating the contact month. Example: (1st mo., 3rd mo. etc.) The "page" column is for reference to the page and numerical monthly number of the customer in the master owners file—example, 3-2/1-A. The 3-2 represents March 2, date of sale, and the 1-A represents page 1, letter A of the master owners file. All pages have references to explain where each notation is to be placed and where it refers to other parts of the portable desk.

It will be appreciated that the same approach as outlined in the example set forth above can be employed for organizing material in apparatus 10 to suit a wide variety of sales approaches or other tasks.

While the invention has been particularly shown and described with reference to a certain embodiment, it will be understood by those skilled in the art that various alterations and modifications in form and detail may be made therein. Accordingly, it is intended that the following claims cover all such alterations and modifications as fall within the true spirit and scope of the invention.

What is claimed is:

1. A portable desk and briefcase apparatus comprising:

a stiff rectangular back member having an inside surface defining a first plane;

stiff rectangular left and right side members having outside surfaces, said members being hingedly attached to said inside surface of said back member in spaced relation to first and second side edges thereof and respectively foldable from open positions with said outside surfaces lying substantially in said first plane to closed positions lying in second and third planes perpendicular to said first plane and lying inwardly of said first and second side edges, said left and right side members being respectively provided with first and second fastening means;

a stiff rectangular bottom member having a first edge hingedly attached to a third edge of said back member and foldable from an open position with an inside surface thereof lying in said first plane to a closed position lying in a fourth plane perpendicular to said first, second and third planes and with side edges thereof disposed outside of said second and third planes;

a stiff rectangular front member having a first edge hingedly attached to a second edge of said bottom member and foldable from an open position with an inside surface thereof lying in said first plane to a closed position lying in a fifth plane parallel to said first plane and with side edges thereof disposed outside of said second and third planes, said front member being provided with third and fourth fastening means respectively disposed proximate second and third edges of said front member, said front member being also provided with a first latching means;

pocket means affixed to the surface of said front member facing said inside surface of said back member when said members are in said closed position, the sides of said pocket means being disposed inwardly of said second and third edges of said front member and forming stops for limiting inwardly folding movement of said side members and providing means for carrying said third and fourth fastening means;

a stiff rectangular top member having a first edge hingedly attached to a fourth edge of said back member and foldable from an open position with an inside surface thereof lying in said first plane to a closed position lying in a sixth plane perpendicular to said first, second and third planes and with side edges thereof disposed outside of said second and third planes;

a rectangular flap member having a first edge hingedly attached to a second edge of said top member, said flap member having second latching means;

binder means affixed to at least one of said top and bottom members for holding work papers; and handle means attached to said top member, whereby when all of said members are in said open position, access is provided to papers affixed to said binder means, and when said members are in said closed positions, said back member, said bottom member, said front member and said top member are held in such positions by the engagement of the inside surfaces thereof with the four edges of said side members and by the engagement of said first and third fastening means, the engagement of said second and fourth fastening means and the engagement of said first and second latching means, and the closed aparatus may be carried by said handle means.

2. A portable desk and briefcase apparatus as recited in claim 1 wherein said first and second fastening means are comprised of strips of hooked material, and said third and fourth fastening means are comprised of strips of looped material such that fastening may be accomplished by moving the hooked material into engagement with the looped material and unfastening may be accomplished by pulling the fastened materials apart with a predetermined force.

3. A portable desk and briefcase apparatus as recited in claim 1, wherein binder means are affixed to the facing surfaces of both said top and bottom members when said members are in said closed position and the respective binding means are disposed in offset positions such that papers held by the respective binder means will be located in side-by-side relationship when said members are in said closed positions.

* * * * *